US009694418B2

(12) United States Patent
Nakajima et al.

(10) Patent No.: US 9,694,418 B2
(45) Date of Patent: Jul. 4, 2017

(54) UP-DRAWING CONTINUOUS CASTING APPARATUS AND UP-DRAWING CONTINUOUS CASTING METHOD

(71) Applicant: TOYOTA JIDOSHA KABUSHIKI KAISHA, Toyota-shi (JP)

(72) Inventors: Tetsuya Nakajima, Toyota (JP); Tsukasa Kato, Toyota (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 0 days.

(21) Appl. No.: 15/108,603

(22) PCT Filed: Dec. 22, 2014

(86) PCT No.: PCT/IB2014/002851

§ 371 (c)(1),
(2) Date: Jun. 28, 2016

(87) PCT Pub. No.: WO2015/104576

PCT Pub. Date: Jul. 16, 2015

(65) Prior Publication Data

US 2016/0325347 A1 Nov. 10, 2016

(30) Foreign Application Priority Data

Jan. 8, 2014 (JP) ..... 2014-001755

(51) Int. Cl.
*B22D 11/14* (2006.01)
*B22D 11/01* (2006.01)

(52) U.S. Cl.
CPC ..... *B22D 11/145* (2013.01); *B22D 11/01* (2013.01)

(58) Field of Classification Search
CPC ..... B22D 11/145; B22D 11/01; B22D 11/041; B22D 11/141
See application file for complete search history.

(56) References Cited

U.S. PATENT DOCUMENTS

2013/0171021 A1 7/2013 Yaokawa et al.

FOREIGN PATENT DOCUMENTS

JP 63-199050 A 8/1988
JP 2012-61518 A 3/2012

OTHER PUBLICATIONS

International Search Report Issued Apr. 24, 2015 in PCT/IB2014/002851 filed Dec. 22, 2014.

*Primary Examiner* — Kevin P Kerns
*Assistant Examiner* — Steven Ha
(74) *Attorney, Agent, or Firm* — Oblon, McClelland, Maier & Neustadt, L.L.P.

(57) ABSTRACT

An up-drawing continuous casting apparatus according to one aspect of the present invention is an up-drawing continuous casting apparatus including a molten metal holding furnace (101) configured to hold molten metal (M1) therein, and a shape determining member (102) placed on a molten metal surface of the molten metal (M1) and configured to determine a sectional shape of a casting (M3) to be casted when retained molten metal (M2) led out from the molten metal surface passes through the shape determining member (102). The shape determining member (102) includes inner shape determining plates (1041, 1042) connectable to each other, and an inner shape determining plate (1043) serving as a connecting member configured to connect the inner shape determining plates (1041, 1042) to each other.

11 Claims, 12 Drawing Sheets

UP-DRAWING CONTINUOUS CASTING APPARATUS AND UP-DRAWING CONTINUOUS CASTING METHOD

BACKGROUND OF THE INVENTION

1. Field of the Invention

The present invention relates to an up-drawing continuous casting apparatus and an up-drawing continuous casting method.

2. Description of Related Art

Japanese Patent Application Publication No. 2012-61518 (JP 2012-61518 A) proposes a free casting method as an epoch-making up-drawing continuous casting method that does not require a mold. As described in JP 2012-61518 A, when a starter is immersed into a surface of molten metal (that is, a molten metal surface) and then the starter is drawn up, the molten metal is also led out following the starter due to a surface film and a surface tension of the molten metal. Here, a casting having a desired sectional shape can be continuously casted by leading out the molten metal via a shape determining member placed near the molten metal surface, and then cooling the molten metal thus led out.

With a normal continuous casting method, the sectional shape and the shape in a longitudinal direction are both determined by a mold. Particularly, in the continuous casting method, solidified metal (i.e., a casting) should pass through a mold, so that a casting casted hereby has a shape that extends linearly in the longitudinal direction. In the meantime, the shape determining member in the free casting method determines only the sectional shape of the casting and does not determine the longitudinal shape thereof. On that account, castings having various longitudinal shapes can be obtained by drawing up the starter while moving the starter (or the shape determining member) horizontally. For example, JP 2012-61518 A describes a hollow casting (that is, a pipe) formed not in a linear shape in its longitudinal direction, but in a zigzag shape or a helical shape in the longitudinal direction. Here, a free casting apparatus described in JP 2012-61518 A can change the sectional shape of the casting by moving the shape determining member.

The inventor(s) found the following problem. JP 2012-61518 A describes that the sectional shape of the casting is changed by moving the shape determining member as described above, but does not describe how the shape determining member is moved at that time. If the shape determining member is deformed so that some parts of the shape determining member are distanced from each other, the sectional shape of the casting cannot be determined in that distanced part. Further, even if a plurality of shape determining members is put on top of one another in advance and the plurality of shape determining members is moved relative to each other within a range where they are put on top of one another, there is a possibility that their moving ranges are limited. That is, the free casting method described in JP 2012-61518 A has a possibility that a degree of freedom of the sectional shape of the casting cannot be improved.

SUMMARY OF THE INVENTION

The present invention provides an up-drawing continuous casting apparatus and an up-drawing continuous casting method each of which can improve a degree of freedom of a sectional shape of a casting.

An up-drawing continuous casting apparatus according to one aspect of the present invention is an up-drawing continuous casting apparatus including: a holding furnace configured to hold molten metal; and a shape determining member placed on a molten metal surface of the molten metal and configured to determine a sectional shape of a casting to be casted when the molten metal led out from the molten metal surface passes through the shape determining member. The shape determining member includes a first partial shape determining member and a second partial shape determining member connectable to each other, and a connecting member configured to connect the first partial shape determining member to the second partial shape determining member. When the first partial shape determining member and the second partial shape determining member are distanced from each other, the sectional shape of the casting to be casted is determined by the first partial shape determining member, the second partial shape determining member, and the connecting member. Hereby, the sectional shape of the casting can be determined with a distanced part being compensated by the connecting member, thereby making it possible to improve a degree of freedom of the sectional shape of the casting.

The connecting member may be a wire or a tape. This makes it possible to achieve downsizing of the shape determining member.

The up-drawing continuous casting apparatus may further include a bobbin around which the wire or the tape is wound. This makes it possible to use the wire stored in the bobbin by drawing out the wire only by a necessary length, thereby making it possible to further improve the degree of freedom of the sectional shape of the casting.

The up-drawing continuous casting apparatus may further include a driving portion configured to rotate the bobbin so as to increase a tensile force of the wire or the tape. Hereby, the wire is restrained from being loose, thereby making it possible to prevent the wire from being drawn up together when the molten metal is drawn up.

The up-drawing continuous casting apparatus may further include an elastic member configured to give a tensile force to the wire or the tape. Hereby, the wire is restrained from being loose, thereby making it possible to prevent the wire from being drawn up together when the molten metal is drawn up.

The connecting member may be a plate.

The connecting member may be an inner shape determining plate.

The connecting member may be a plurality of plate materials slidable in a horizontal direction.

The connecting member may be a plate material having a bellows shape.

The up-drawing continuous casting apparatus may be configured such that: when the starter is immersed into the molten metal surface of the molten metal and then the starter is drawn up, the molten metal follows the starter due to a surface film and a surface tension of the molten metal and the molten metal is led out; the molten metal is led out via the shape determining member provided near the molten metal surface; and the molten metal is cooled off so as to continuously cast the casting having a desired sectional shape.

An up-drawing continuous casting method according to one aspect of the present invention is an up-drawing continuous casting method for casting a casting such that molten metal is led out from a molten metal surface of the molten metal held in a holding furnace and is passed through a shape determining member configured to determine a sectional shape of the casting, and is configured to determine the sectional shape of the casting to be casted, by a first partial shape determining member, a second partial shape determining member, and a connecting member when the first partial shape determining member and the second partial shape determining member are distanced from each other, the first partial shape determining member and the second partial shape determining member being connectable to each other, the connecting member being configured to connect the first partial shape determining member to the second partial shape determining member. Hereby, the sectional shape of the casting can be determined with a distanced part being compensated by the connecting member, thereby making it possible to improve a degree of freedom of the sectional shape of the casting.

According to the present invention, it is possible to provide an up-drawing continuous casting apparatus and an up-drawing continuous casting method each of which can improve a degree of freedom of a sectional shape of a casting.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

The following describes concrete embodiments to which the present invention is applied with reference to the drawings. However, the present invention is not limited to the following embodiments. Further, the following description and drawings are simplified appropriately for clarification of the description.

Embodiment 1

Figure 1:
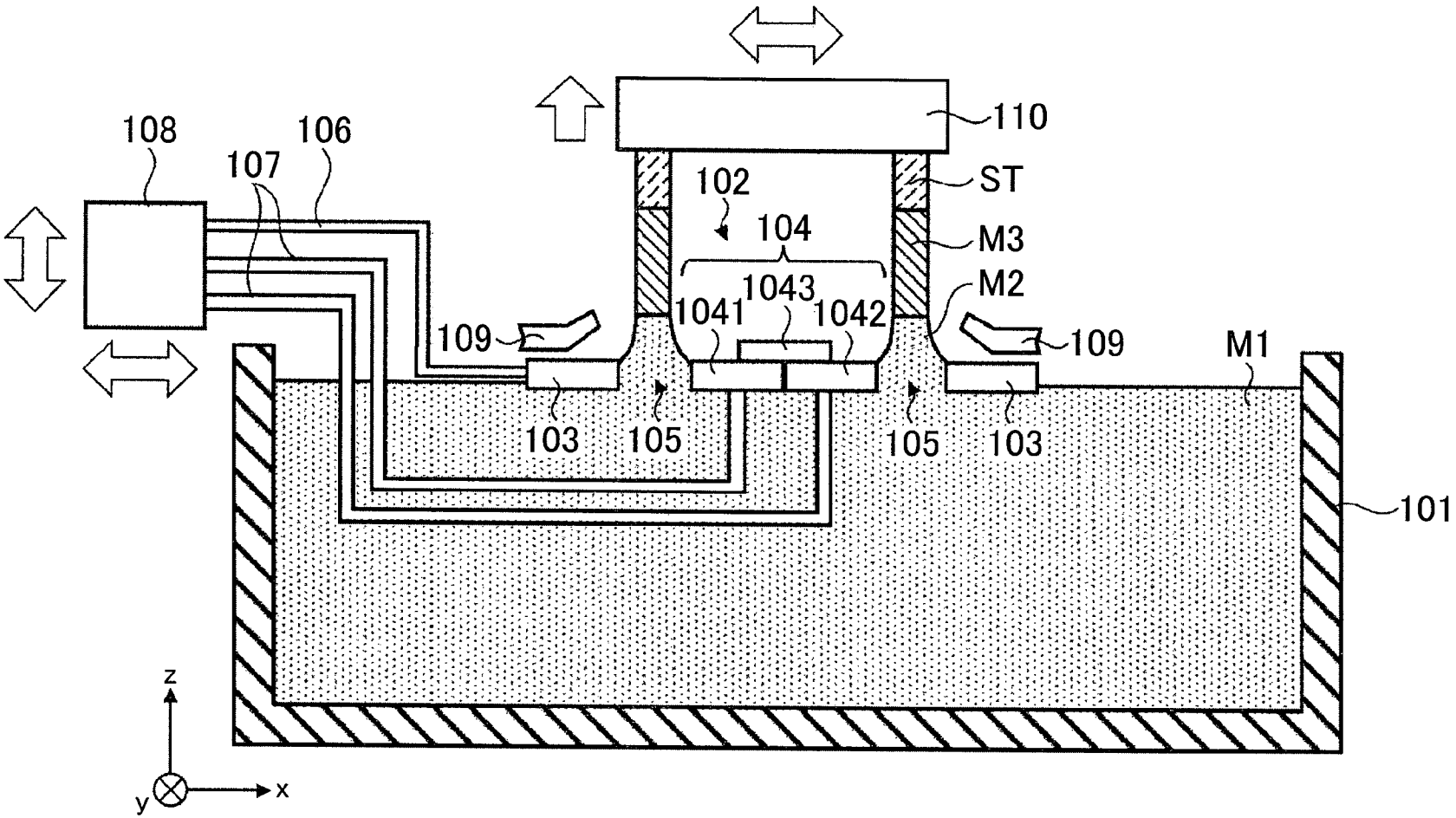
FIG. 1 is a sectional view schematically illustrating a free casting apparatus according to Embodiment 1.

First described is a free casting apparatus (an up-drawing continuous casting apparatus) according to Embodiment 1, with reference to FIG. 1. FIG. 1 is a sectional view schematically illustrating the free casting apparatus according to Embodiment 1. As illustrated in FIG. 1, the free casting apparatus according to Embodiment 1 includes a molten metal holding furnace (holding furnace) 101, a shape determining member 102, support rods 106, 107, an actuator 108, a coolant gas nozzle (cooling portion) 109, and a draw-up machine 110. The xyz right handed coordinate system is illustrated in FIG. 1 for convenience of description of a positional relationship between constituents. A xy plane in FIG. 1 constitutes a horizontal plane, and a z-axis direction is a vertical direction. More specifically, a positive direction of the z axis is an upper side in the vertical direction.

The molten metal holding furnace 101 stores therein molten metal M1 of aluminum or its alloy, for example, and keeps the molten metal M1 at a predetermined temperature (e.g., around 720° C.) at which the molten metal M1 has fluidity. In the example in FIG. 1, molten metal is not replenished into the molten metal holding furnace 101 during casting, so that a surface of the molten metal M1 (i.e., a molten metal surface) drops as the casting proceeds. However, molten metal may be replenished, as needed, into the molten metal holding furnace 101 during casting such that the molten metal surface is kept constant. Here, when a preset temperature of the molten metal holding furnace 101 is increased, a position of a solidification interface SIF (described later) can be raised. When the preset temperature of the molten metal holding furnace 101 is decreased, the position of the solidification interface SIF can be lowered. Naturally, the molten metal M1 may be of metal or its alloy other than aluminum.

The shape determining member 102 is made of ceramics or stainless, for example, and is placed on the molten metal M1. The shape determining member 102 includes an outer shape determining member 103 and an inner shape determining member 104. The outer shape determining member 103 determines an outer sectional shape of a casting M3 to be casted, and the inner shape determining member 104 determines an inner sectional shape of the casting M3 to be casted. The casting M3 illustrated in FIG. 1 is a hollow casting (that is, a pipe) of which a horizontal section (hereinafter referred to as a transverse section) has a tubular shape.

In the example illustrated in FIG. 1, the outer shape determining member 103 and the inner shape determining member 104 are placed so that their principal planes (bottom faces) on a lower side make contact with the molten metal surface. This prevents an oxide film formed on the surface of the molten metal M1 and foreign matters floating on the surface of the molten metal M1 from mixing into the casting M3. In the meantime, the outer shape determining member 103 and the inner shape determining member 104 may be placed so that their bottom faces do not make contact with the molten metal surface. More specifically, the outer shape determining member 103 and the inner shape determining member 104 may be placed so that their bottom faces are distanced from the molten metal surface by a predetermined distance (e.g., around 0.5 mm). Hereby, heat deformation and erosion of the outer shape determining member 103 and the inner shape determining member 104 are restrained, so durability thereof is improved.

Figure 2:
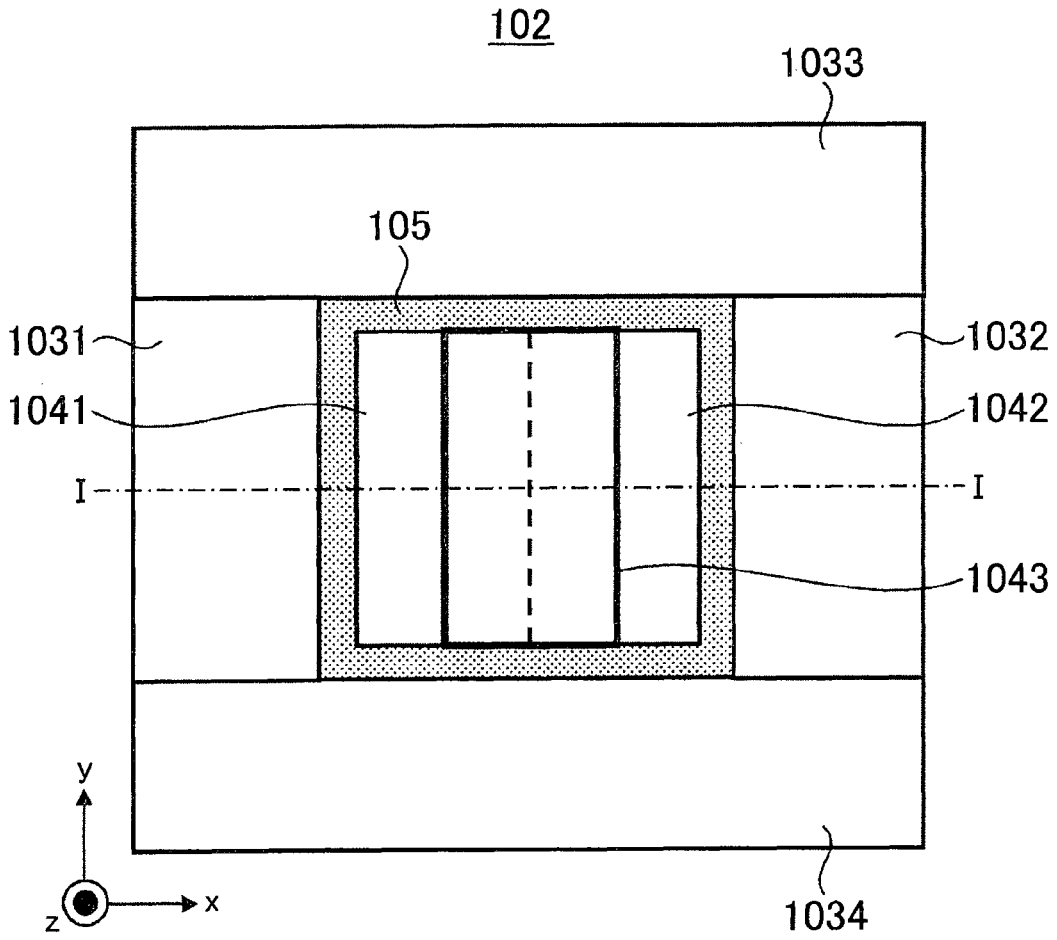
FIG. 2 is a plan view of a shape determining member 102 illustrated in FIG. 1.

FIG. 2 is a plan view of the shape determining member 102 illustrated in FIG. 1. Here, the sectional view of the shape determining member 102 of FIG. 1 corresponds to a sectional view taken along a line I-I in FIG. 2. In the example of FIG. 2, the outer shape determining member 103 is constituted by four outer shape determining plates (partial shape determining members) 1031 to 1034, and the inner shape determining member 104 is constituted by inner shape determining plates (first and second partial shape determining members) 1041, 1042, and an inner shape determining plate 1043 serving as a connecting member configured to connect the inner shape determining plates 1041, 1042 to each other. Note that the xyz coordinate in FIG. 2 is the same coordinate as in FIG. 1.

As illustrated in FIG. 2, the outer shape determining plates 1031, 1032 constituting parts of the outer shape determining member 103 have generally the same rectangular flat shape, and arranged side by side in an x-axis direction at an interval in an opposed manner. The outer shape determining plates 1033, 1034 constituting the other parts of the outer shape determining member 103 have generally the same rectangular flat shape, and are arranged side by side in a y-axis direction in an opposed manner so as to sandwich the outer shape determining plates 1031, 1032 therebetween. A rectangular opening surrounded by the outer shape determining plates 1031 to 1034 is formed in a center of the outer shape determining member 103. Here, the outer shape determining plates 1031, 1032 are independently movable in the x-axis direction.

Further, as illustrated in FIG. 2, the inner shape determining member 104 constituted by the inner shape determining plates 1041 to 1043 has a rectangular flat shape, and is placed in a center of the opening of the outer shape determining member 103. More specifically, the inner shape determining plates 1041, 1042 constituting parts of the inner shape determining member 104 have generally the same rectangular flat shape, and are adjacently arranged side by side in the x-axis direction in the center of the opening of the outer shape determining member 103. The inner shape determining plate 1043 constituting the other part of the inner shape determining member 104 has a rectangular flat shape, and is placed on top faces of the inner shape determining plates 1041, 1042 so as to cover a border line therebetween.

Note that, in this example, the inner shape determining plate 1043 is placed so that, in a plan view, a top side thereof is placed on the same straight line as top sides of the inner shape determining plates 1041, 1042, and a bottom side thereof is placed on the same straight line as bottom sides of the inner shape determining plates 1041, 1042. However, the flat shape and a placement position of the inner shape determining plate 1043 are modifiable appropriately depending on an inner sectional shape of the casting M3.

Here, the inner shape determining plates 1041, 1042 are independently movable (connectable and disconnectable) in the x-axis direction. Further, the inner shape determining plate 1043 is also movable in the x-axis direction over the inner shape determining plates 1041, 1042. For example, a slider extending in the x-axis direction is provided on a bottom face of the inner shape determining plate 1043, and rails extending in the x-axis direction and guiding the slider are provided on top faces of the inner shape determining plates 1041, 1042, so that the inner shape determining plate 1043 is slidable in the x-axis direction over the inner shape determining plates 1041, 1042. Note that moving ranges of the inner shape determining plates 1041 to 1043 are within a range where a distanced part (a space SP) between the inner shape determining plates 1041, 1042 is covered with the inner shape determining plate 1043 at the time when the inner shape determining plates 1041, 1042 are distanced from each other.

A gap between the outer shape determining member 103 and the inner shape determining member 104 serves as a molten metal passage portion 105 through which the molten metal passes.

In the example of FIGS. 1 and 2, the inner shape determining plates 1041, 1042 are placed so as to make contact with each other, so the space SP is not formed between the inner shape determining plates 1041, 1042. Accordingly, the inner sectional shape of the casting M3 is determined only by two inner shape determining plates 1041, 1042 constituting parts of the inner shape determining member 104.

Figure 3:
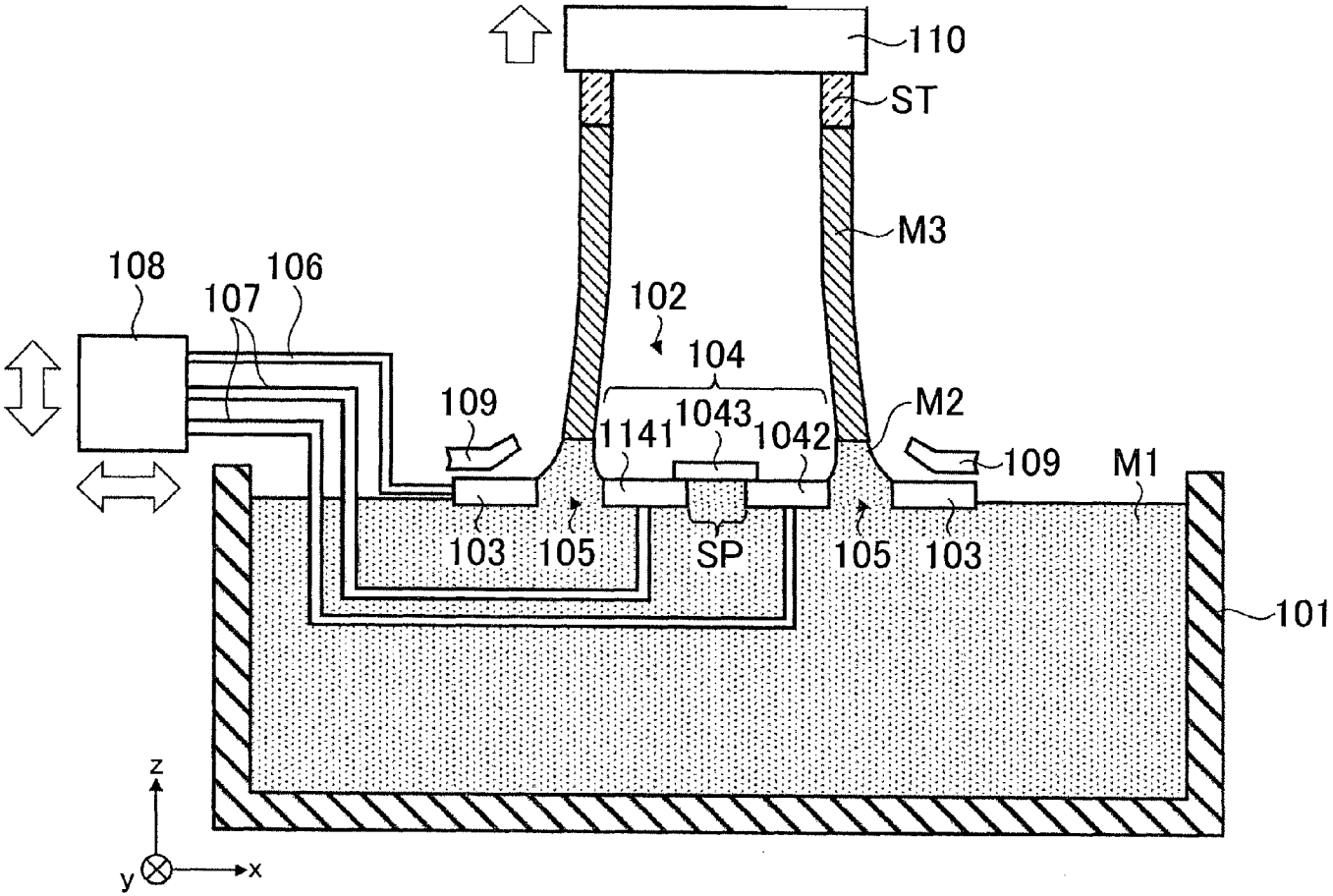
FIG. 3 is a sectional view schematically illustrating the free casting apparatus according to Embodiment 1.
Figure 4:
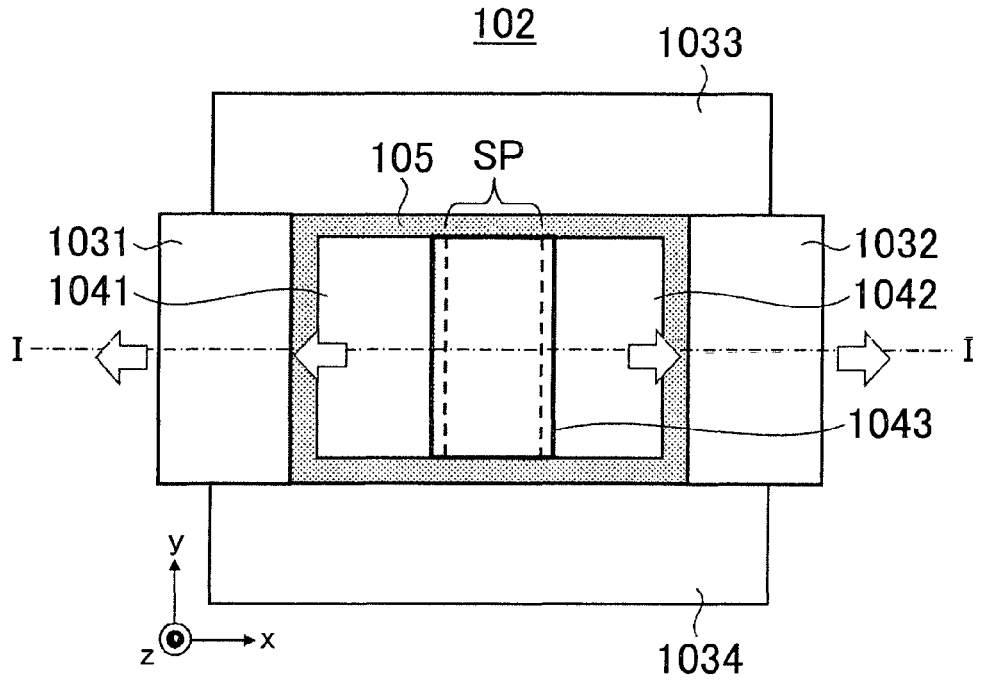
FIG. 4 is a plan view of a shape determining member 102 illustrated in FIG. 3.

Referring now to FIGS. 3 and 4, the following describes the free casting apparatus according to Embodiment 1 when the sectional shape of the casting M3 is changed. FIG. 3 is a sectional view schematically illustrating the free casting apparatus according to Embodiment 1 when the sectional shape of the casting M3 is changed along with progression of casting. FIG. 4 is a plan view of the shape determining member 102 illustrated in FIG. 3. In the example of FIGS. 3 and 4, the sectional shape of the casting M3 is enlarged in the x-axis direction. Note that the xyz coordinates in FIGS. 3, 4 are the same coordinate as in FIG. 1.

As illustrated in FIGS. 3 and 4, the outer shape determining plates 1031, 1032 move toward a negative side and a positive side in the x-axis direction, respectively. Along with that, the inner shape determining plates 1041, 1042 move toward the negative side and the positive side in the x-axis direction, respectively. That is, the inner shape determining plates 1041, 1042 are distanced from each other in the x-axis direction. Accordingly, the space SP is formed between the inner shape determining plates 1041, 1042. However, at this time, the inner shape determining plate 1043 is placed to cover the space SP.

The inner shape determining plate 1043 determines part of the inner sectional shape of the casting M3 so as to compensate a part corresponding to the space SP. That is, when the inner shape determining plates 1041, 1042 are distanced from each other to form the space SP, the inner sectional shape of the casting M3 is determined by the inner shape determining plates 1041, 1042, and the inner shape determining plate 1043. In the example of FIG. 4, a top side of the inner sectional shape of the casting M3 is determined by the top sides of the inner shape determining plates 1041 to 1043, and a bottom side of the inner sectional shape of the casting M3 is determined by the bottom sides of the inner shape determining plates 1041 to 1043, in a plan view. Hereby, the inner shape determining member 104 can give a desired sectional shape (a rectangular sectional shape enlarged in the x-axis direction in this example) to the casting M3 without suffering a loss of part of the sectional shape of the casting M3 due to the space SP.

Now referring back to FIG. 1 (or FIG. 3), the draw-up machine 110 grips a starter (a leading member) ST to immerse the starter ST into the molten metal M1 and draw up the starter ST thus immersed in the molten metal M1.

As illustrated in FIG. 1, after the molten metal M1 is connected to the starter ST thus immersed therein, the molten metal M1 is drawn up following the starter ST with its outer shape being maintained due to its surface film and surface tension, and passes through the molten metal passage portion 105. When the molten metal M1 passes through the molten metal passage portion 105, an external force is applied to the molten metal M1 from the shape determining member 102, so that the sectional shape of the casting M3 is determined. Here, the molten metal drawn up, from the molten metal surface, following the starter ST (or the casting M3 formed such that the molten metal M1 drawn up following the starter ST solidifies) due to the surface film and the surface tension of the molten metal M1 is referred to as retained molten metal M2. Further, a boundary between the casting M3 and the molten metal M2 is the solidification interface SIF.

The starter ST is made of ceramics or stainless, for example. Note that a surface of the starter ST may be covered with a protective surface film of salt crystals or the like. Hereby, a molten connection between the starter ST and the molten metal M1 is restrained, thereby making it possible to improve releasability between the starter ST and the casting M3. This allows the starter ST to be reused. Further, in a case where the surface of the starter ST is covered with the protective surface film, it is preferable that the surface of the starter ST have an irregular shape. This causes the protective surface film to be easily attached (deposited) onto the surface of the starter ST, thereby making it possible to further improve the releasability between the starter ST and the casting M3. At the same time, it is possible to improve cohesive strength between the starter ST and the molten metal M1 in a draw-up direction at the time of leading out the molten metal.

The support rod 106 supports the outer shape determining member 103, and the support rod 107 supports the inner shape determining member 104. Here, if the support rod 107 has a pipe structure so that coolant gas is flowed therethrough, and further, a jetting hole is provided in the inner shape determining member 104, the casting M3 can be cooled off from its inside.

The support rods 106, 107 are both connected to the actuator 108. The actuator 108 can move the outer shape determining member 103 and the inner shape determining member 104 in an up-down direction (the z-axis direction) via the support rods 106, 107. This makes it possible to move the shape determining member 102 downward when the casting proceeds and the molten metal surface drops.

Further, the actuator 108 can move the outer shape determining member 103 and the inner shape determining member 104 in a horizontal direction (the x-axis direction and the y-axis direction) via the support rods 106, 107. This makes it possible to change the longitudinal shape of the casting M3 freely. Here, the actuator 108 can independently move the outer shape determining plates 1031, 1032 and the inner shape determining plates 1041 to 1043, as described above. This makes it possible to change the sectional shape of the casting M3 freely.

The coolant gas nozzle 109 cools off the starter ST and the casting M3 by spraying coolant gas (air, nitrogen, argon, or the like) thereon. When a flow rate of the coolant gas is increased, the position of the solidification interface SIF is lowered, and when the flow rate of the coolant gas is decreased, the position of the solidification interface SIF is raised. Note that the coolant gas nozzle 109 is also movable in the up-down direction (the z-axis direction) and in the horizontal direction (the x-axis direction and the y-axis direction). Accordingly, the coolant gas nozzle 109 can be moved downward along with downward movement of the shape determining member 102 when the casting proceeds and the molten metal surface drops, for example. Alternatively, the coolant gas nozzle 109 can be moved in the horizontal direction along with horizontal movement of the draw-up machine 110 and the shape determining member 102.

When the starter ST or the casting M3 is cooled off by the coolant gas with the casting M3 being drawn up by the draw-up machine 110 connected to the starter ST, the retained molten metal M2 near the solidification interface SIF solidifies sequentially from an upper side (a positive side in the z-axis direction) to a lower side (a negative side in the z-axis direction), and thus, the casting M3 is formed. When a draw-up speed by the draw-up machine 110 is increased, the position of the solidification interface SIF can be raised. When the draw-up speed is decreased, the position of the solidification interface SIF can be lowered. Further, it is possible to freely change the longitudinal shape of the casting M3 by drawing up the casting M3 with the draw-up machine 110 being moved in the horizontal direction (in the x-axis direction and the y-axis direction), similarly to a case where the shape determining member 102 is moved in the horizontal direction.

With reference to FIGS. 1 to 4, the following describes a free casting method according to the present embodiment.

Initially, a tip end (a lower end) of the starter ST is immersed into the molten metal M1 by moving the starter ST1 downward by the draw-up machine 110 so as to pass the starter ST through the molten metal passage portion 105 between the outer shape determining member 103 and the inner shape determining member 104.

Then, the starter ST is drawn up at a predetermined speed. Here, even if the starter ST is distanced from the molten metal surface, the molten metal M1 is drawn up (led out), from the molten metal surface, following the starter ST due to its surface film and surface tension, so that the retained molten metal M2 is formed. As illustrated in FIG. 1, the retained molten metal M2 is formed in the molten metal passage portion 105. That is, a shape is given to the retained molten metal M2 by the shape determining member 102.

Then, the starter ST and the casting M3 are cooled off by the coolant gas sprayed from the coolant gas nozzle 109. Hereby, the retained molten metal M2 is cooled off indirectly and solidifies sequentially from the upper side to the lower side, so that the casting M3 grows. Thus, the casting M3 can be casted continuously.

Here, in a case where the sectional shape of the casting M3 is enlarged in the x-axis direction, the outer shape determining plates 1031, 1032 are moved toward the negative side and the positive side in the x-axis direction, respectively, and the inner shape determining plates 1041, 1042 are moved toward the negative side and the positive side in the x-axis direction, respectively. Hereby, the space SP is formed between the inner shape determining plates 1041, 1042. However, at this time, the inner shape determining plate 1043 is placed to cover the space SP. The inner shape determining plate 1043 determines part of the inner sectional shape of the casting M3 so as to compensate a part corresponding to the space SP. Hereby, the inner shape determining member 104 can give a desired sectional shape (a rectangular sectional shape enlarged in the x-axis direction in this example) to the casting M3 without suffering a loss of part of the sectional shape of the casting M3 due to the space SP.

Thus, in the free casting apparatus according to the present embodiment, when the inner shape determining plates 1041, 1042 are distanced from each other to form the space SP, the sectional shape of the casting M3 is determined by the inner shape determining plates 1041, 1042, and the inner shape determining plate 1043 as a connecting member.

Hereby, in the free casting apparatus according to the present embodiment, a desired sectional shape can be given to the casting M3 without suffering a loss of part of the sectional shape of the casting M3 due to the space SP. That is, the free casting apparatus according to the present embodiment can improve a degree of freedom of the sectional shape of the casting M3.

Embodiment 2

Figure 5:
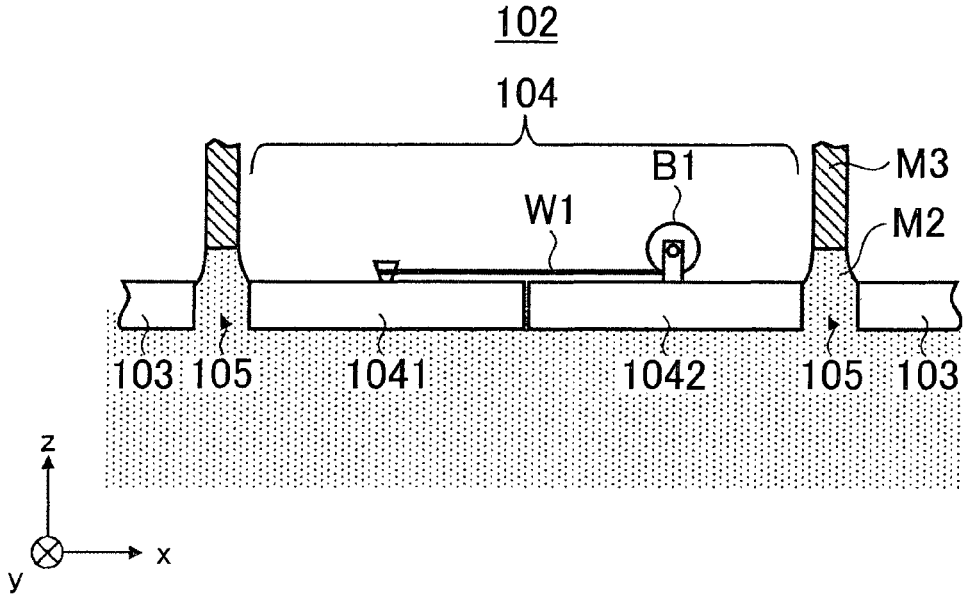
FIG. 5 is a sectional view illustrating a shape determining member 102 according to Embodiment 2.
Figure 6:
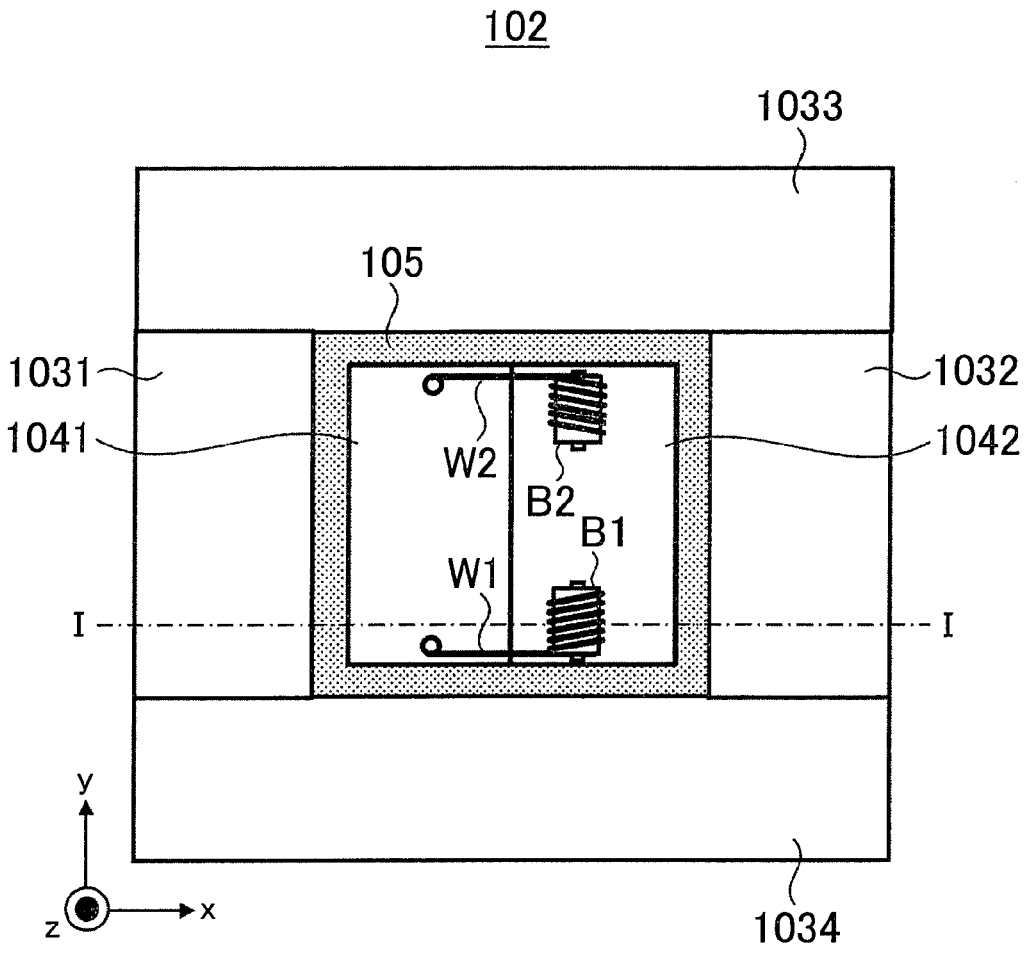
FIG. 6 is a plan view of the shape determining member 102 illustrated in FIG. 5.
Figure 7:
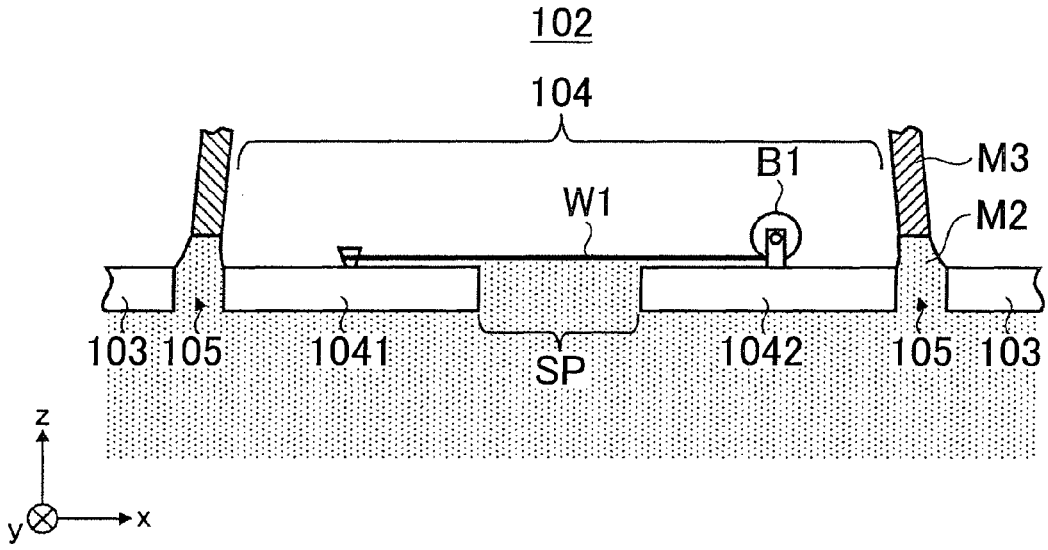
FIG. 7 is a sectional view illustrating the shape determining member 102 according to Embodiment 2.
Figure 8:
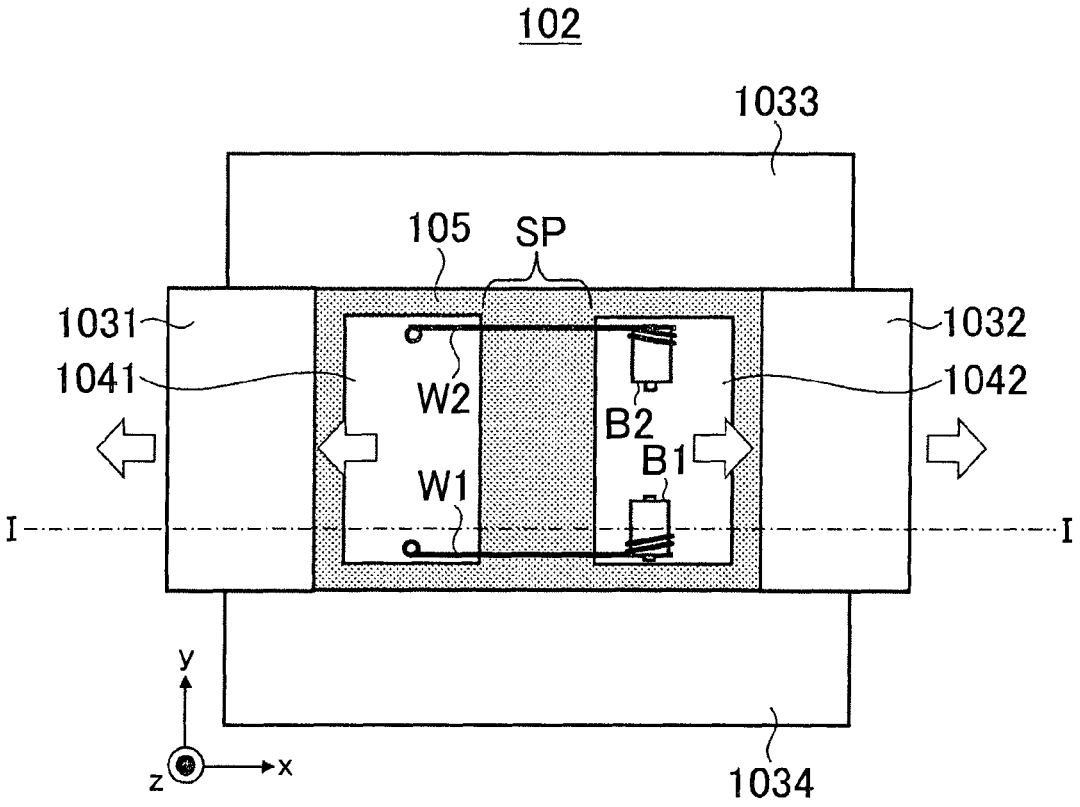
FIG. 8 is a plan view of the shape determining member 102 illustrated in FIG. 7.

A free casting apparatus according to Embodiment 2 includes a shape determining member 102 having a different structure from the free casting apparatus according to Embodiment 1. FIG. 5 is a sectional view illustrating the shape determining member 102 according to Embodiment 2. FIG. 6 is a plan view of the shape determining member 102 illustrated in FIG. 5. FIG. 7 is a sectional view illustrating the shape determining member 102 according Embodiment 2 when a sectional shape of a casting M3 is enlarged. FIG. 8 is a plan view of the shape determining member 102 illustrated in FIG. 7. Note that the xyz coordinates in FIGS. 5 to 8 are the same coordinate as in FIG. 1.

In comparison with the shape determining member 102 illustrated in FIGS. 1 to 4, the shape determining member 102 illustrated in FIGS. 5 to 8 includes wires W1, W2 as a connecting member, and bobbins B1, B2, instead of the inner shape determining plate 1043. The other configuration of the shape determining member 102 illustrated in FIGS. 5 to 8 is the same as in the case of the shape determining member 102 illustrated in FIGS. 1 to 4, so description thereof is omitted.

The wires W1, W2 are made of a heat resisting material such as alumina fiber, or a metallic material having a high-melting point such as stainless. The wires W1, W2 may be a solid wire or a twisted wire, but the twisted wire is hard to cause raveling and winding curl.

As illustrated in FIG. 6 and so on, the wires W1, W2 and the bobbins B1, B2 are both placed on a top face of an inner shape determining member 104. In a plan view, one end of the wire W1 is fixed to near a bottom side of an inner shape determining plate 1041, and the other end of the wire W1 is wound around the bobbin B1 placed near a bottom side of an inner shape determining plate 1042. In a plan view, one end of the wire W2 is fixed to near a top side of the inner shape determining plate 1041, and the other end side of the wire W2 is wound around the bobbin B2 placed near a top side of the inner shape determining plate 1042.

That is, in a plan view, the wire W1 is placed so as to extend in the x-axis direction from the bottom side of the inner shape determining plate 1041 to the bottom side of the inner shape determining plate 1042. Further, in a plan view, the wire W2 is placed so as to extend in the x-axis direction from the top side of the inner shape determining plate 1041 to the top side of the inner shape determining plate 1042. Note that, in this example, in a plan view, the wire W1 is placed on the same straight line as the bottom sides of the inner shape determining plates 1041, 1042. Further, in a plan view, the wire W2 is placed on the same straight line as the top sides of the inner shape determining plates 1041, 1042. However, placement positions of the wires W1, W2 are modifiable appropriately depending on an inner sectional shape of the casting M3.

Here, a driving portion configured to rotate the bobbins B1, B2 may be further provided so as to increase tensile forces of the wires W1, W2. Hereby, the wires W1, W2 are restrained from being loose, thereby making it possible to prevent the wires W1, W2 from being drawn up together when the molten metal M1 is drawn up.

In the example of FIGS. 5, 6, the inner shape determining plates 1041, 1042 are placed so as to make contact with each other, so no space SP is formed between the inner shape determining plates 1041, 1042. Accordingly, an inner sectional shape of the casting M3 is determined only by two inner shape determining plates 1041, 1042 constituting parts of the inner shape determining member 104.

Subsequently, in the example of FIGS. 7 and 8, outer shape determining plates 1031, 1032 move toward the negative side and the positive side in the x-axis direction, respectively. Along with that, the inner shape determining plates 1041, 1042 move toward the negative side and the positive side in the x-axis direction, respectively. That is, the inner shape determining plates 1041, 1042 are distanced from each other in the x-axis direction. Accordingly, a space SP is formed between the inner shape determining plates 1041, 1042. However, since the inner shape determining plates 1041, 1042 are distanced from each other, the wires W1, W2 wound around the bobbins B1, B2 are drawn out. Consequently, in the space SP, the wire W1 connecting the bottom sides of the inner shape determining plates 1041, 1042 to each other and the wire W2 connecting the top sides thereof to each other are placed.

The wires W1, W2 determine part of the inner sectional shape of the casting M3 so as to compensate a part corresponding to the space SP. That is, when the inner shape determining plates 1041, 1042 are distanced from each other to form the space SP, the inner sectional shape of the casting M3 is determined by the wires W1, W2, as well as the inner shape determining plates 1041, 1042. In the example of FIG. 8, a bottom side of the inner sectional shape of the casting M3 is determined by the bottom sides of the inner shape determining plates 1041, 1042 and the wire W1, and a top side of the inner sectional shape of the casting M3 is determined by the top sides of the inner shape determining plates 1041, 1042 and the wire W2, in a plan view. Hereby, the inner shape determining member 104 can give a desired sectional shape (a rectangular sectional shape enlarged in the x-axis direction in this example) to the casting M3 without suffering a loss of part of the sectional shape of the casting M3 due to the space SP.

Thus, in the free casting apparatus according to the present embodiment, when the inner shape determining plates 1041, 1042 are distanced from each other to form the space SP, the sectional shape of the casting M3 is determined by the wires W1, W2 as a connecting member, as well as the inner shape determining plates 1041, 1042. Hereby, in the free casting apparatus according to the present embodiment, a desired sectional shape can be given to the casting M3 without suffering a loss of part of the sectional shape of the casting M3 due to the space SP. That is, the free casting apparatus according to the present embodiment can improve a degree of freedom of the sectional shape of the casting M3.

Further, in the free casting apparatus according to the present embodiment, the wires W1, W2 are provided as a connecting member configured to connect the inner shape determining plates 1041, 1042, thereby making it possible to achieve downsizing of the shape determining member 102. Further, the bobbins B1, B2 are provided, so that the wires W1, W2 stored in the bobbins B1, B2 can be used by drawing out the wires W1, W2 only by a necessary length, thereby making it possible to further improve the degree of freedom of the sectional shape of the casting M3.

(First Modification of Shape Determining Member 102 According Embodiment 2)

Figure 9:
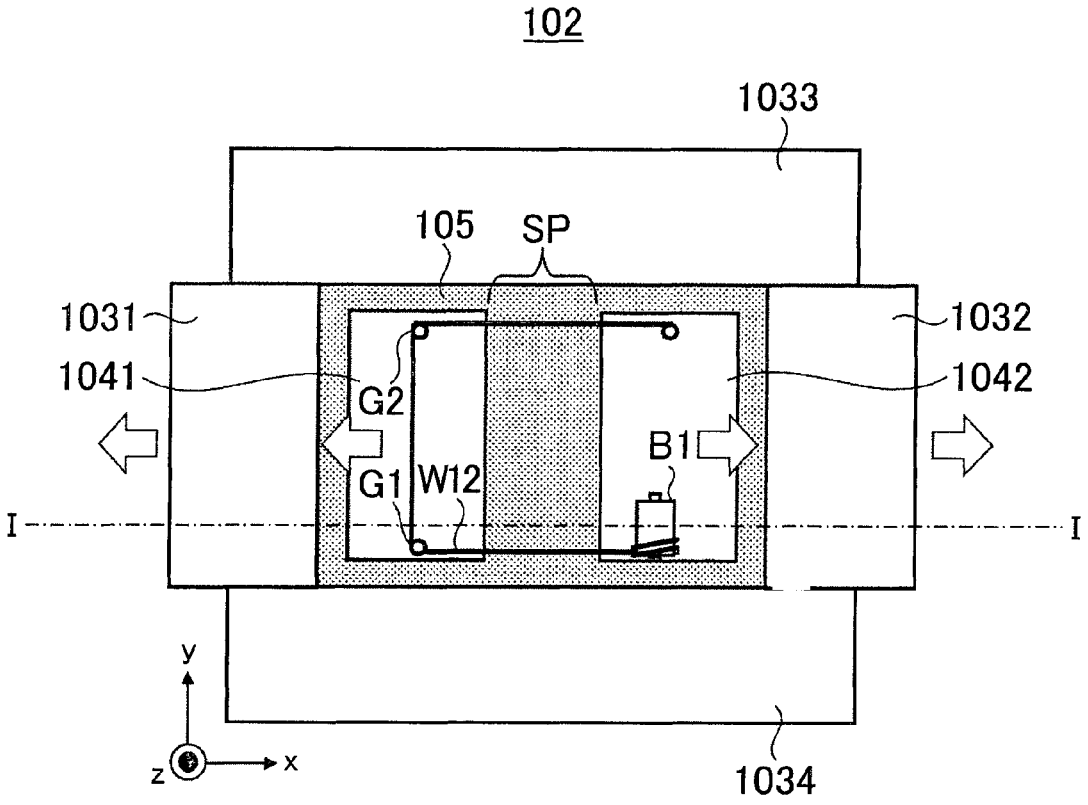
FIG. 9 is a plan view illustrating a first modification of the shape determining member 102 according to Embodiment 2.

FIG. 9 is a plan view illustrating a first modification of the shape determining member 102 according to Embodiment 2. Note that the xyz coordinate in FIG. 9 is the same coordinate as in FIG. 1. The shape determining member 102 illustrated in FIG. 9 includes, instead of two wires W1, W2, a single wire W12 that functions as both the wires W1, W2, as a connecting member.

As illustrated in FIG. 9, the wire W12, a bobbin B1 around which the wire W12 is wound, guides G1, G2 configured to guide the wire W12 are provided on a top face of an inner shape determining member 104. In a plan view, the wire W12 extends from the bobbin B1 placed near a bottom side of the inner shape determining plate 1042 to near a top side of the inner shape determining plate 1042 via the guides G1, G2 provided on near the bottom side of the inner shape determining plate 1041 and near the top side thereof, respectively. Note that one end of the wire W12 is wound around the bobbin B1, and the other end of the wire W12 is fixed near the top side of the inner shape determining plate 1042.

With such a configuration, the shape determining member 102 illustrated in FIG. 9 can yields an effect equivalent to the shape determining member 102 illustrated in FIGS. 5 to 8.

Note that the shape determining member 102 illustrated in FIG. 9 may be further provided with a bobbin B2 around which the other end of the wire W12 is to be wound. At this time, the bobbin B1 is used only for sending out of the wire W12 and the bobbin B2 is used only for rewinding of the wire W12, for example, so that it is possible to continuously provide sectional shapes to the casting M3 by use of a new part of the wire.

(Second Modification of Shape Determining Member 102 According Embodiment 2)

Figure 10:
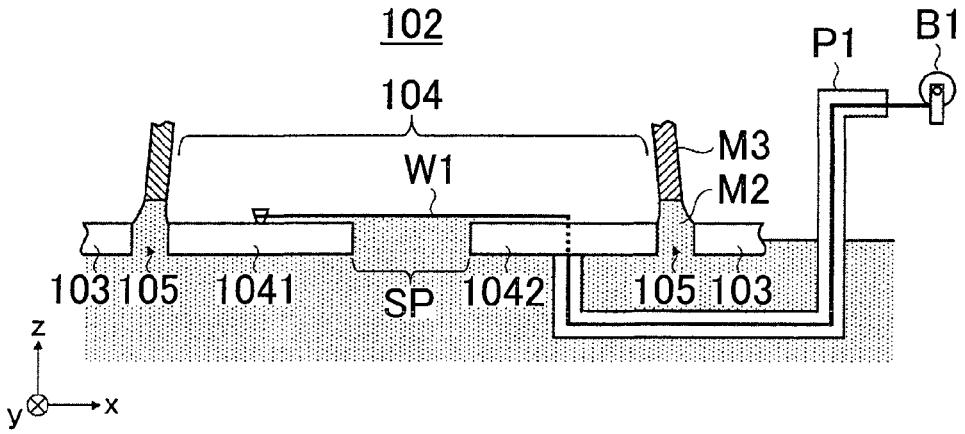
FIG. 10 is a sectional view illustrating a second modification of the shape determining member 102 according to Embodiment 2.

FIG. 10 is a sectional view illustrating a second modification of the shape determining member 102 according Embodiment 2. Note that the xyz coordinate in FIG. 10 is the same coordinate as in FIG. 1. In the shape determining member 102 illustrated in FIG. 10, bobbins B1, B2 (only B1 is illustrated) are provided not on a top face of the shape determining member 102, but outside the apparatus. The wires W1, W2 (only W1 is illustrated) extend from the bobbins B1, B2 provided outside the apparatus to the shape determining member 102 via a pipe P1 provided inside the molten metal M1. Note that the pipe P1 is made of a heat resisting material such as alumina fiber, or a metallic material having a high-melting point such as stainless. With such a configuration, it is possible to prevent overheat of the bobbins B1, B2 and the wires W1, W2.

(Third Modification of Shape Determining Member 102 According Embodiment 2)

Figure 11:
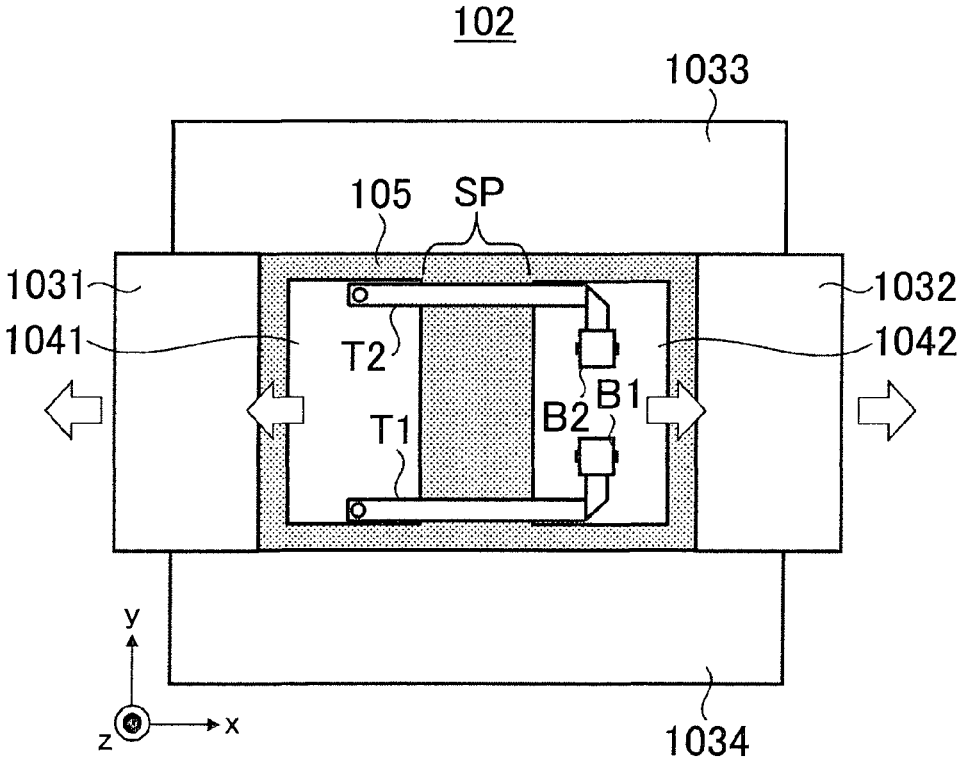
FIG. 11 is a plan view illustrating a third modification of the shape determining member 102 according to Embodiment 2.

FIG. 11 is a plan view illustrating a third modification of the shape determining member 102 according to Embodiment 2. Note that the xyz coordinate in FIG. 11 is the same coordinate as in FIG. 1. The shape determining member 102 illustrated in FIG. 11 includes tapes T1, T2 as a connecting member instead of the wires W1, W2. The tapes T1, T2 are made of a material similar to that of the wires W1, W2.

With such a configuration, the shape determining member 102 illustrated in FIG. 11 can yield an effect equivalent to the shape determining member 102 illustrated in FIGS. 5 to 8.

Note that, in the example of FIG. 11, bobbins B1, B2 are provided not near ends of an inner shape determining plate 1042, but near a center of the inner shape determining plate 1042 in a plan view. The tapes T1, T2 extending from an inner shape determining plate 1041 toward the inner shape determining plate 1042 are folded on the inner shape determining plate 1042, so as to be wound around the bobbins B1, B2 provided near the center of the inner shape determining plate 1042. With such a configuration, it is possible to prevent the bobbins B1, B2 from making contact with a casting M3 and retained molten metal M2.

Note that the first to third modifications of the shape determining member 102 may be used by combining some of them or all of them.

Embodiment 3

Figure 12:
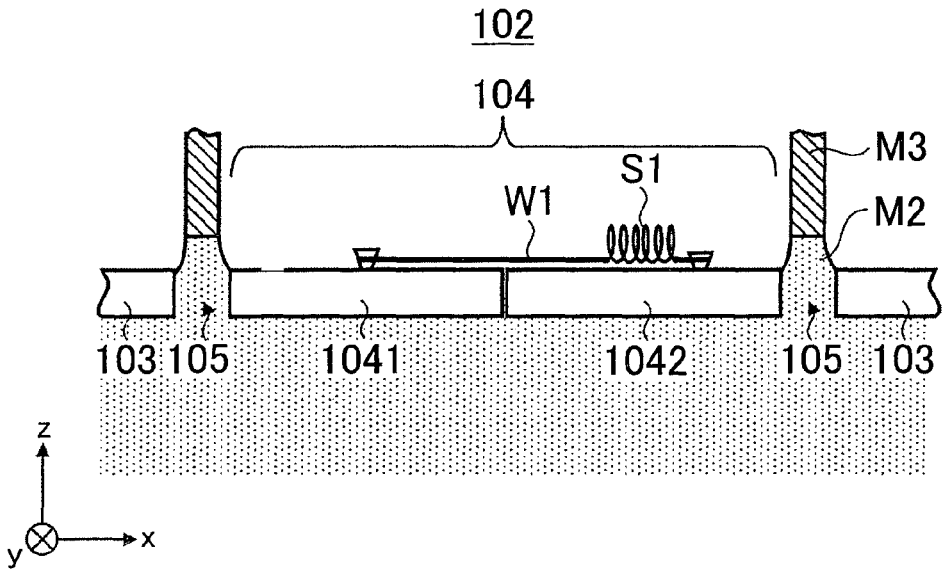
FIG. 12 is a sectional view illustrating a shape determining member 102 according to Embodiment 3.
Figure 13:
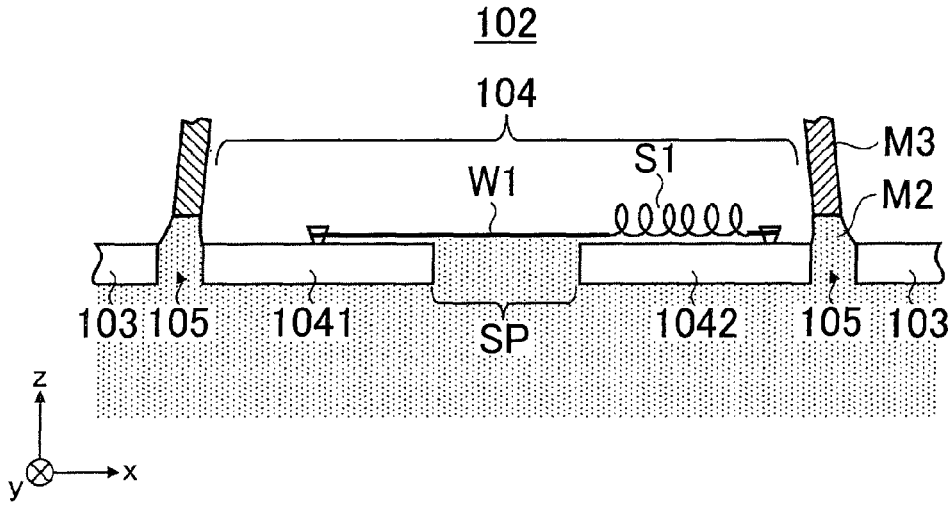
FIG. 13 is a sectional view illustrating the shape determining member 102 according to Embodiment 3.

A free casting apparatus according to Embodiment 3 includes a shape determining member 102 having a different structure from the free casting apparatuses according to Embodiments 1, 2. FIG. 12 is a sectional view illustrating the shape determining member 102 according Embodiment 3. FIG. 13 is a sectional view illustrating the shape determining member 102 according Embodiment 3 when a sectional shape of a casting M3 is enlarged. Note that the xyz coordinates in FIGS. 12, 13 are the same coordinate as in FIG. 1.

The shape determining member 102 illustrated in FIGS. 12 and 13 includes elastic members S1, S2 (only S1 is illustrated) instead of the bobbins B1, B2, in comparison with the shape determining member 102 illustrated in FIGS. 5 to 8. The other configuration of the shape determining member 102 illustrated in FIGS. 12 and 13 is the same as the shape determining member 102 illustrated in FIGS. 5 to 8, so description thereof is omitted.

The elastic members S1, S2 are springs, for example, and give tensile forces to wires W1, W2, respectively. With such a configuration, the wires W1, W2 are restrained from being loose, so it is possible to prevent the wires W1, W2 from being drawn up together when molten metal M1 is drawn up.

Embodiment 4

Figure 14:
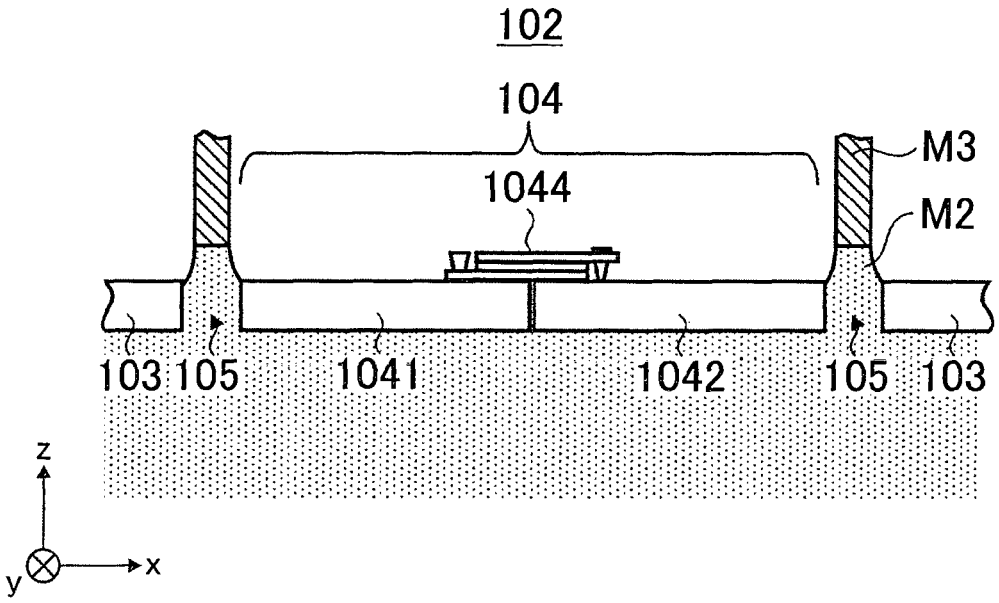
FIG. 14 is a sectional view illustrating a shape determining member 102 according to Embodiment 4.
Figure 15:
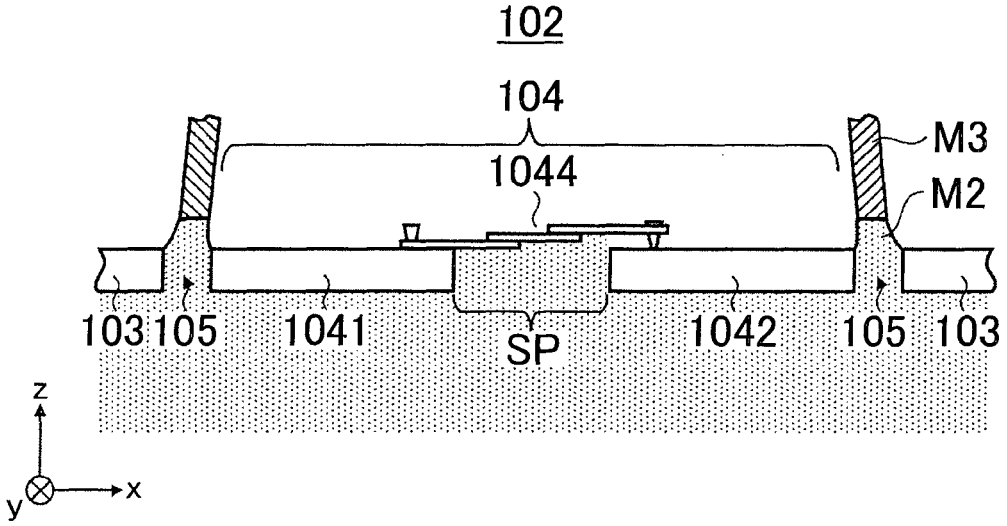
FIG. 15 is a sectional view illustrating the shape determining member 102 according to Embodiment 4.

A free casting apparatus according to Embodiment 4 includes a shape determining member 102 having a different structure from the free casting apparatuses according to Embodiments 1 to 3. FIG. 14 is a sectional view illustrating the shape determining member 102 according Embodiment 4. FIG. 15 is a sectional view illustrating the shape determining member 102 according Embodiment 4 when a sectional shape of a casting M3 is enlarged. Note that the xyz coordinates in FIGS. 14, 15 are the same coordinate as in FIG. 1.

The shape determining member 102 illustrated in FIGS. 14 and 15 includes, as a connecting member, a plurality of plate materials 1044 slidable in the horizontal direction, instead of the wires W1, W2. When inner shape determining plates 1041, 1042 make contact with each other, the plurality of plate materials 1044 overlap with each other in the z-axis direction, and when the inner shape determining plates 1041, 1042 are distanced from each other, the plurality of plate materials 1044 slide in the horizontal direction (in this example, in the x-axis direction) so as to cover a distanced part (a space SP). The other configuration of the shape determining member 102 illustrated in FIGS. 14 and 15 is the same as the shape determining member 102 illustrated in FIGS. 1 to 4, so description thereof is omitted.

With such a configuration, the shape determining member 102 illustrated in FIGS. 14 and 15 can further enlarge an inner sectional shape of the casting M3 in the x-axis direction, in comparison with the shape determining member 102 illustrated in FIGS. 1 to 4. That is, the free casting apparatus according to the present embodiment can improve a degree of freedom of the sectional shape of the casting M3.

Embodiment 5

Figure 16:
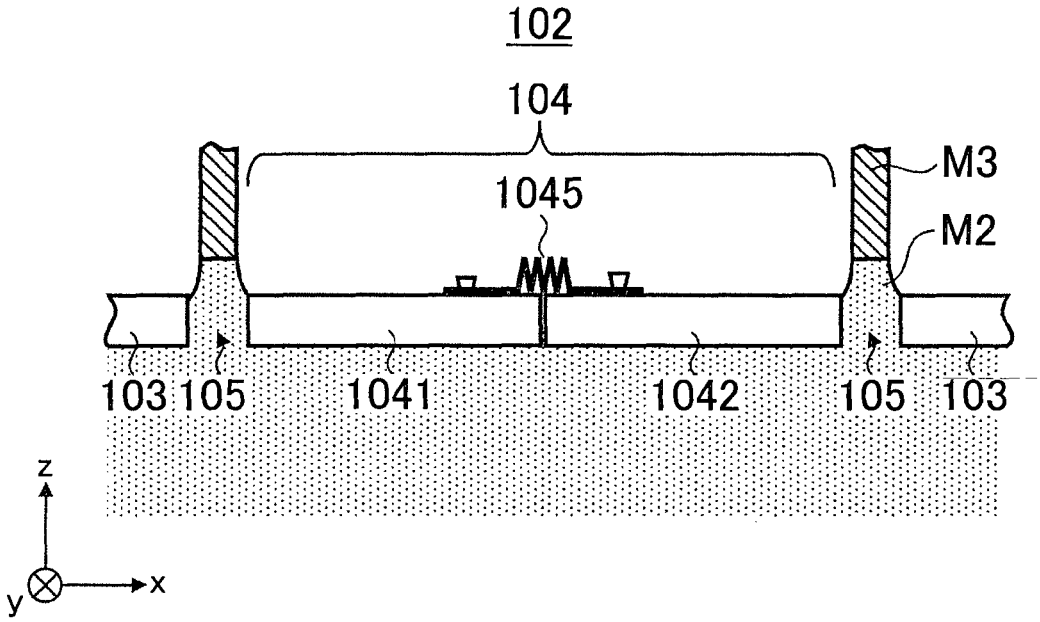
FIG. 16 is a sectional view illustrating a shape determining member 102 according to Embodiment 5.
Figure 17:
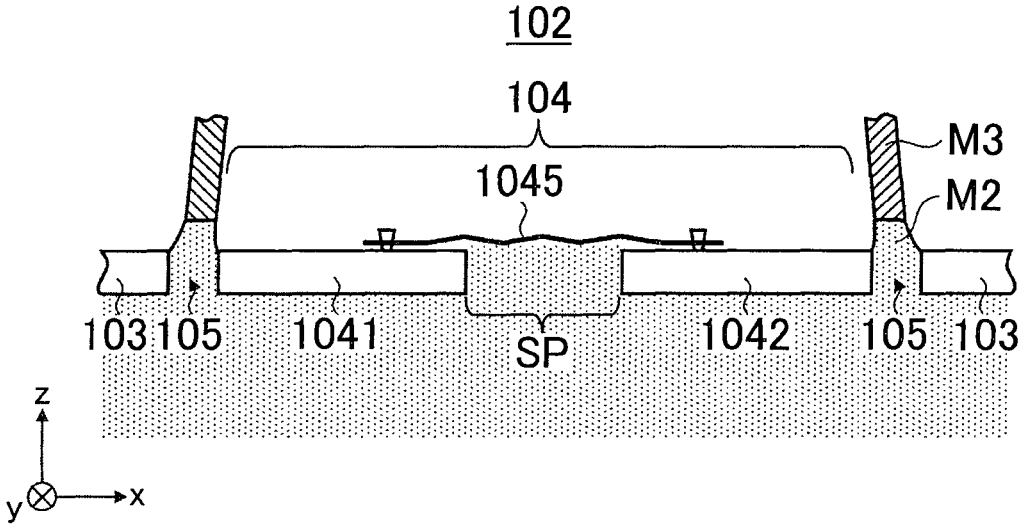
FIG. 17 is a sectional view illustrating the shape determining member 102 according to Embodiment 5.

A free casting apparatus according to Embodiment 5 includes a shape determining member 102 having a different structure from the free casting apparatuses according to Embodiments 1 to 4. FIG. 16 is a sectional view illustrating the shape determining member 102 according Embodiment 5. FIG. 17 is a sectional view illustrating the shape determining member 102 according Embodiment 5 when a sectional shape of a casting M3 is enlarged. Note that the xyz coordinates in FIGS. 16, 17 are the same coordinate as in FIG. 1.

The shape determining member 102 illustrated in FIGS. 16 and 17 includes, as a connecting member, a plate material 1045 having a bellows shape in a moving direction (in this example, in the x-axis direction) of inner shape determining plates 1041, 1042, instead of the wires W1, W2. When the inner shape determining plates 1041, 1042 make contact with each other, the plate material 1045 is contracted in the x-axis direction such that crest parts and valley parts of the bellows shape are folded. When the inner shape determining plates 1041, 1042 are distanced from each other, the plate material 1045 is stretched in the x-axis direction such that the crest parts and the valley parts of the bellows shape thus folded are unfolded, so as to cover a distanced part (a space SP). The other configuration of the shape determining member 102 illustrated in FIGS. 16 and 17 is the same as in the case of the shape determining member 102 illustrated in FIGS. 1 to 4, so description thereof is omitted.

With such a configuration, the shape determining member 102 illustrated in FIGS. 16 and 17 can enlarge an inner sectional shape of the casting M3 in the x-axis direction, similarly to the case of the shape determining member 102 illustrated in FIGS. 1 to 4. That is, the free casting apparatus according to the present embodiment can improve a degree of freedom of the sectional shape of the casting M3.

As described above, in the free casting apparatuses according to Embodiments 1 to 5, when the inner shape determining plates 1041, 1042 are distanced from each other to form the space SP, the sectional shape of the casting M3 is determined by the inner shape determining plates 1041, 1042, and the connecting member (the inner shape determining plate 1043, the wires W1, W2, the tapes T1, T2, or the like). Hereby, in the free casting apparatuses according to Embodiments 1 to 5, a desired sectional shape can be given to the casting M3 without suffering a loss of part of the sectional shape of the casting M3 due to the space SP. That is, the free casting apparatuses according to Embodiments 1 to 5 can improve the degree of freedom of the sectional shape of the casting M3.

Embodiments 1 to 5 deal with a case where the inner shape determining plates 1041, 1042 connectable to and disconnectable from each other, and the connecting member (the inner shape determining plate 1043, the wires W1, W2, the tapes T1, T2, or the like) configured to connect them are provided, but Embodiments 1 to 5 are not limited to this. First and second outer shape determining members connectable to and disconnectable from each other, and a connecting member configured to connect them may be provided. In such a configuration, when the first and second outer shape determining members make contact with each other, an outer sectional shape of a casting to be casted is determined only by the first and second outer shape determining members, and when the first and second outer shape determining members are distanced from each other, the outer sectional shape of the casting to be casted is determined by the first and second outer shape determining members and the connecting member.

Note that the present invention is not limited to the above embodiments, and various modifications can be made within a range that does not deviate from a gist of the present invention.

The invention claimed is:

1. An up-drawing continuous casting apparatus comprising:

a holding furnace configured to hold molten metal; and a shape determining member placed on a molten metal surface of the molten metal and configured to determine a sectional shape of a casting to be casted when the molten metal led out from the molten metal surface passes through the shape determining member, wherein:

the shape determining member includes a first partial shape determining member and a second partial shape determining member connectable to each other, and a connecting member configured to connect the first partial shape determining member to the second partial shape determining member; and when the first partial shape determining member and the second partial shape determining member are distanced from each other, the sectional shape of the casting to be casted is determined by the first partial shape determining member, the second partial shape determining member, and the connecting member.

2. The up-drawing continuous casting apparatus according to claim 1, wherein:

the connecting member is a wire or a tape.

3. The up-drawing continuous casting apparatus according to claim 2, further comprising:

a bobbin around which the wire or the tape is wound.

4. The up-drawing continuous casting apparatus according to claim 3, further comprising:

a driving portion configured to rotate the bobbin so as to increase a tensile force of the wire or the tape.

5. The up-drawing continuous casting apparatus according to claim 2, further comprising:

an elastic member configured to give a tensile force to the wire or the tape.

6. The up-drawing continuous casting apparatus according to claim 1, wherein:

the connecting member is a plate.

7. The up-drawing continuous casting apparatus according to claim 6, wherein:

the connecting member is an inner shape determining plate.

8. The up-drawing continuous casting apparatus according to claim 6, wherein:

the connecting member is a plurality of plate materials slidable in a horizontal direction.

9. The up-drawing continuous casting apparatus according to claim 6, wherein:

the connecting member is a plate material having a bellows shape.

10. The up-drawing continuous casting apparatus according to claim 1, wherein:

when a starter is immersed into the molten metal surface of the molten metal and then the starter is drawn up, the molten metal follows the starter due to a surface film and a surface tension of the molten metal and the molten metal is led out;

the molten metal is led out via the shape determining member provided near the molten metal surface; and the molten metal is cooled off so as to continuously cast the casting having a desired sectional shape.

11. An up-drawing continuous casting method for casting a casting such that molten metal is led out from a molten metal surface of the molten metal held in a holding furnace and is passed through a shape determining member configured to determine a sectional shape of the casting, the method comprising:

determining the sectional shape of the casting to be casted, by a first partial shape determining member, a second partial shape determining member, and a connecting member when the first partial shape determining member and the second partial shape determining member are distanced from each other, the first partial shape determining member and the second partial shape determining member being connectable to each other, the connecting member being configured to connect the first partial shape determining member to the second partial shape determining member.

* * * * *